US007070125B2

(12) United States Patent
Williams et al.

(10) Patent No.: US 7,070,125 B2
(45) Date of Patent: Jul. 4, 2006

(54) MULTI-PATTERN PULL-OUT SPRAY HEAD

(75) Inventors: Alston Edward Williams, Irvine, CA (US); Mark S. Bloom, Mission Viejo, CA (US); Steve Nadler, Trabuco Canyon, CA (US)

(73) Assignee: Newfrey LLC, Newark, DE (US)

( * ) Notice: Subject to any disclaimer, the term of this patent is extended or adjusted under 35 U.S.C. 154(b) by 290 days.

(21) Appl. No.: 10/439,355

(22) Filed: May 16, 2003

(65) Prior Publication Data

US 2004/0227014 A1 Nov. 18, 2004

(51) Int. Cl.
*A62C 31/00* (2006.01)
*B05B 1/30* (2006.01)

(52) U.S. Cl. ..... 239/443; 239/444; 239/445; 239/574

(58) Field of Classification Search ..... 239/443, 239/444, 445, 390, 391, 396, 436, 442, 574
See application file for complete search history.

(56) References Cited

U.S. PATENT DOCUMENTS

| | | | | | |
|---|---|---|---|---|---|
| 1,556,979 | A | * | 10/1925 | Uschman | 137/886 |
| 1,840,812 | A | | 1/1932 | Hardy | |
| 2,438,471 | A | * | 3/1948 | Ball | 239/300 |
| 2,559,559 | A | | 7/1951 | Isenberg | |
| 3,404,410 | A | | 10/1968 | Sumida | |
| 3,998,390 | A | | 12/1976 | Peterson et al. | |
| 4,068,801 | A | | 1/1978 | Leutheuser | |
| 4,094,468 | A | | 6/1978 | Volle | |
| 4,204,646 | A | | 5/1980 | Shames et al. | |
| 4,209,132 | A | * | 6/1980 | Kwan | 239/381 |
| RE30,350 | E | | 7/1980 | Peterson et al. | |
| 4,588,130 | A | * | 5/1986 | Trenary et al. | 239/381 |
| 4,629,125 | A | | 12/1986 | Liu | |
| 4,650,120 | A | | 3/1987 | Kress | |
| 4,703,893 | A | | 11/1987 | Gruber | |
| 4,903,897 | A | | 2/1990 | Hayes | |
| 5,158,234 | A | | 10/1992 | Magnenat et al. | |
| 5,172,866 | A | | 12/1992 | Ward | |
| 5,213,267 | A | | 5/1993 | Heimann et al. | |
| 5,215,258 | A | | 6/1993 | Jursich | |
| 5,230,106 | A | | 7/1993 | Henkin et al. | |
| 5,232,162 | A | | 8/1993 | Chih | |
| 5,294,054 | A | | 3/1994 | Benedict et al. | |
| 5,348,228 | A | | 9/1994 | Wang | |
| 5,398,872 | A | | 3/1995 | Joubran | |
| 5,518,181 | A | | 5/1996 | Shames et al. | |
| 5,647,537 | A | | 7/1997 | Bergmann | |
| 5,772,120 | A | | 6/1998 | Huber | |
| 5,806,771 | A | | 9/1998 | Loschelder et al. | |
| 5,860,599 | A | | 1/1999 | Lin | |
| 5,918,816 | A | * | 7/1999 | Huber | 239/391 |
| 5,937,905 | A | | 8/1999 | Santos | |
| 6,113,009 | A | | 9/2000 | Chih | |
| 6,126,091 | A | | 10/2000 | Heitzman | |
| 6,145,757 | A | | 11/2000 | Knapp | |
| 6,151,729 | A | | 11/2000 | Yean | |
| 6,286,767 | B1 | | 9/2001 | Hui-Chen | |
| 6,296,011 | B1 | | 10/2001 | Esche et al. | |
| 6,322,005 | B1 | | 11/2001 | Kern et al. | |
| 6,341,737 | B1 | | 1/2002 | Chang | |
| 2001/0023901 | A1 | * | 9/2001 | Haverstraw et al. | 239/443 |

* cited by examiner

*Primary Examiner*—William C. Doerrler
(74) *Attorney, Agent, or Firm*—Harness, Dickey & Pierce, P.L.C.

(57) ABSTRACT

A faucet head having a multi-pattern head and a fluid diversion system. The multi-pattern head has a stream outlet, a first spray outlet, and a second spray outlet. The fluid diversion system comprises a first valve, a second valve, and a water supply input. A first discharge pattern is characterized by the fluid diversion system connecting the stream outlet to the water supply input. A second discharge pattern is characterized by the fluid diversion system connecting the first spray outlet to the water supply input. A third discharge pattern is characterized by the fluid diversion system connecting the first spray outlet and the second spray outlet to the water supply input.

29 Claims, 9 Drawing Sheets

MULTI-PATTERN PULL-OUT SPRAY HEAD

FIELD OF THE INVENTION

The present invention relates to a faucet assembly, and more particularly, to a pull-out faucet head with multiple fluid output patterns available by selectively operating multiple valves.

BACKGROUND OF THE INVENTION

Spray heads mounted to faucets are used in many residential, industrial and commercial settings and perform many functions. The spray heads can be mounted to conventional faucets or to faucets with additional features. Some exemplary features include various forms of temperature and fluid control, ability to pull out the spray head, and multiple spray patterns.

Some spray heads offer multiple spray patterns but often require two-handed movement of spray discs or radial handles to manipulate the spray head into different spray modes. Further, some spray heads only offer an aerated flow and a spray flow. Previous spray head designs achieved some of the above function but required many parts and were larger and heavier. There is, therefore, room in the art for improvement. Accordingly, it is desirable to offer a spray head with new functionality, in a small, light and appealing package that is easy to use and readily attaches to many faucets or similar installations.

SUMMARY OF THE INVENTION

The present invention provides a pull-out head of a faucet that includes a housing, a fluid diversion system and a multi-pattern head. The fluid diversion system includes a series of channels, paths, or flow passageways and first and second valves for selectively directing fluid communication through the pull-out head. The first valve is disposed in a first valve body and switchable between a first position and a second position. The first valve body also has a first port, a second port, and a third port. The second valve is disposed in a second valve body switchable between a third position and a fourth position. The second valve body has a fourth port, a fifth port, and a sixth port.

A first channel or path has a first input end adapted to be in fluid communication with a water supply or path and a first output end fluidly connected to the first port of the first valve body. A second channel or path has a second input end fluidly connected to the second port of the first valve body and a second output end adapted to emit a fluid. A third channel or path has a third input end fluidly connected to the third port of the first valve body, and a third output end fluidly connected to the fourth port of the second valve body. A fourth channel or path has a fourth input end fluidly connected to the fifth port of the second valve body and a fourth output end adapted to emit a fluid. A fifth channel or path has a fifth input end fluidly connected to the sixth port of the second valve body and a fifth output end adapted to emit a fluid.

When in the first position the first valve seals the third port of the first valve body. When in the second position the first valve seals the second port of the first valve body. When in the third position the second valve seals the sixth port of the second valve body. When in the fourth position the second valve leaves open the fourth port, the fifth port, and the sixth port. Thus, the first valve is operable to select between first and second output patterns and the second valve is operable to modify the second output pattern.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description, the appended claims, and the accompanying drawings, wherein:

DETAILED DESCRIPTION OF THE PREFERRED EMBODIMENT

The following description of the preferred embodiment is merely exemplary in nature and is in no way intended to limit the invention, its application, or uses.

Figure 1:
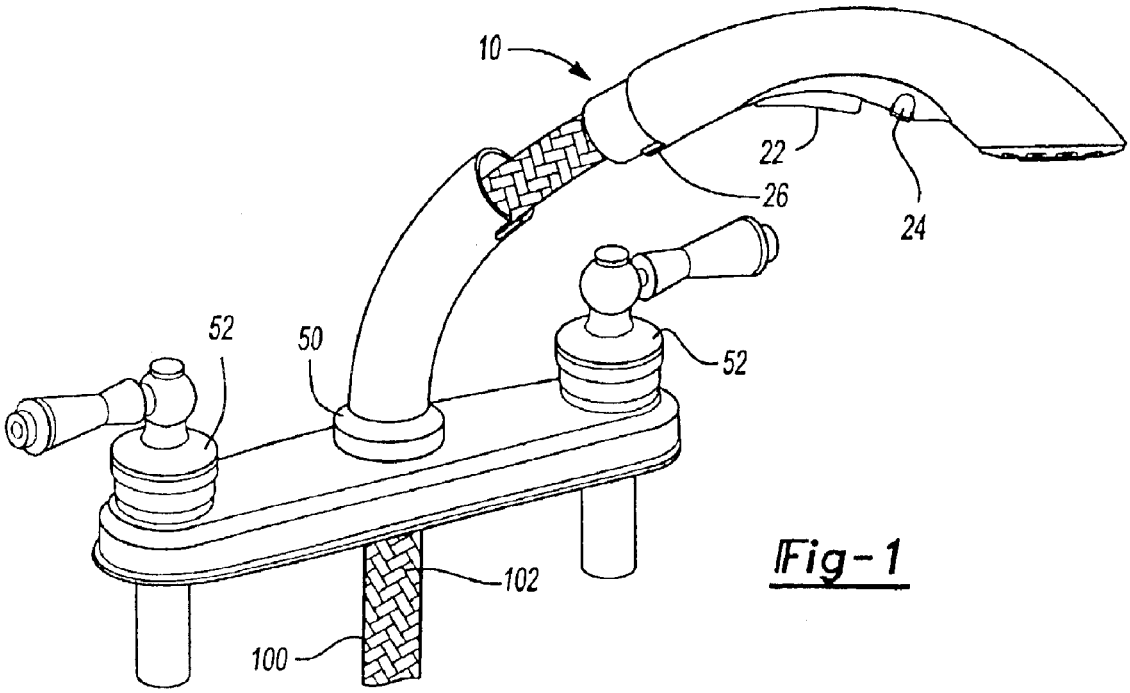
FIG. 1 is a simplified side view of a multi-pattern spray head constructed in accordance with the principles of the present invention and connected to an exemplary faucet and sink that shows water connections and a temperature/flow control of the present invention.

With reference to FIG. 1, a multi-pattern pull-out spray head of the preferred embodiment of the present invention is generally indicated by reference numeral 10. The spray head 10 of the preferred embodiment of the present invention is configured to be a pull-out spray head mounted to a faucet body 50. With flow control valves 52, the faucet 50 provides temperature control and flow regulation of a fluid, most notably water, to the spray head 10. One skilled in the art will readily appreciate that the spray head 10 may be attached to other water sources, two such exemplary water sources being a garden hose (not shown) and a faucet with only hot or cold water service (not shown).

Figure 2:
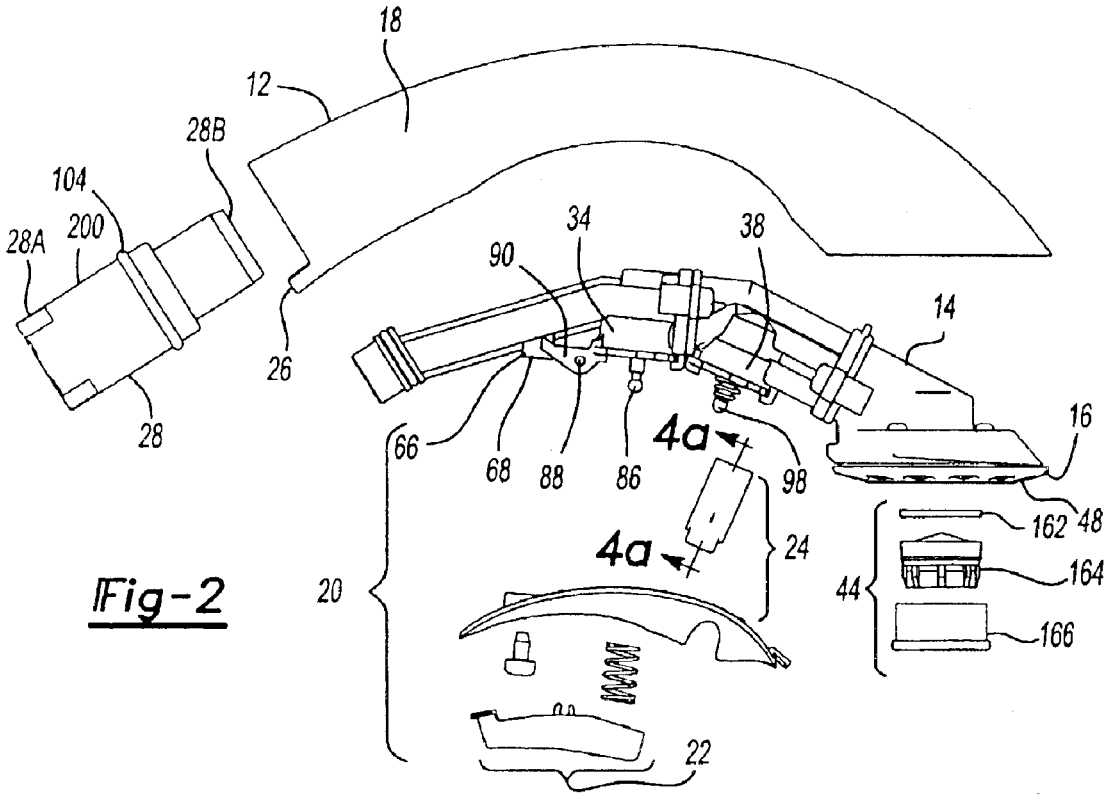
FIG. 2 is an exploded view of the spray head of FIG. 2 showing portions of the housing, the fluid diversion system, the switch cover assembly, and the aerator assembly of the present invention.
Figure 3:
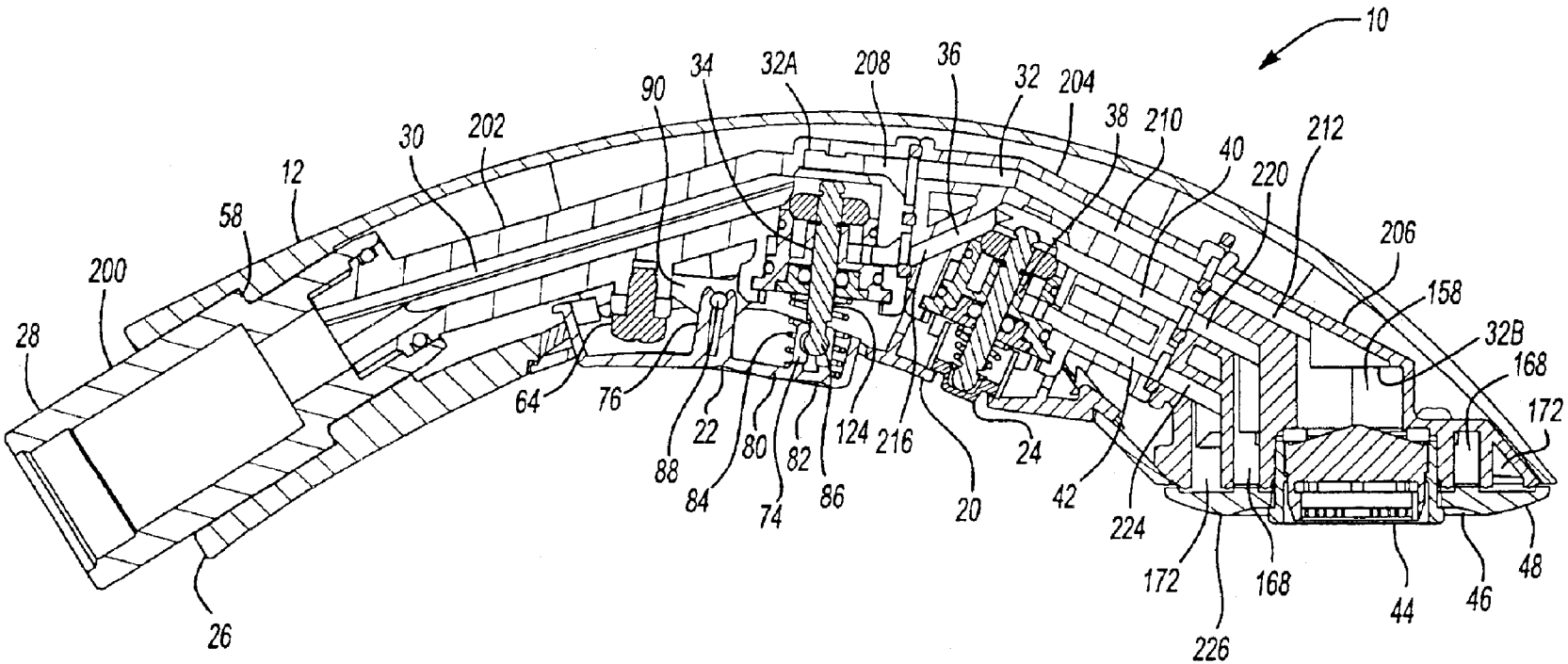
FIG. 3 is a side cross-sectional view of spray head of FIG. 2.

With reference to FIGS. 2 and 3, the pull-out spray head 10 includes a housing 12, a fluid diversion system 14, and a multi-pattern head 16. The housing 12 further includes a cover 18, a switch cover assembly 20, a rocker switch assembly 22, a sliding switch assembly 24, and a mating notch 26. The fluid diversion system 14 further includes a housing inlet 28, a first path 30, a second path 32, a first valve assembly 34, a third path 36, a second valve assembly 38, a fourth path 40, and a fifth path 42. The multi-pattern head 16 further includes a stream outlet assembly 44, a first annular outlet assembly 46, and a second annular outlet assembly 48.

Figure 5A:
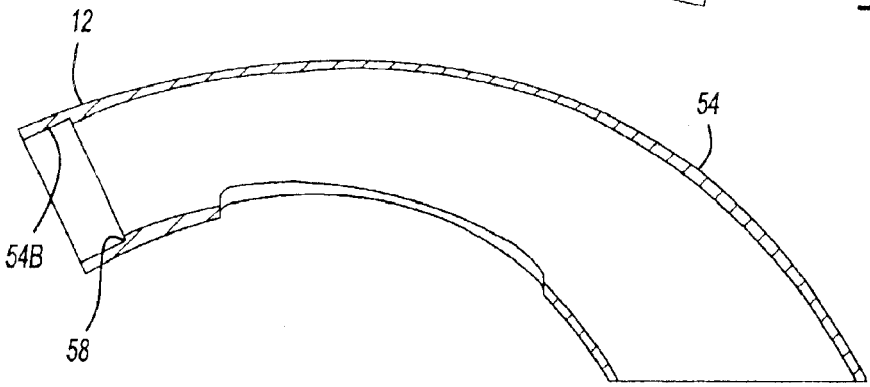
FIG. 5*a* is a side cross-sectional view of the housing of the spray head of FIG. 2.
Figure 5B:
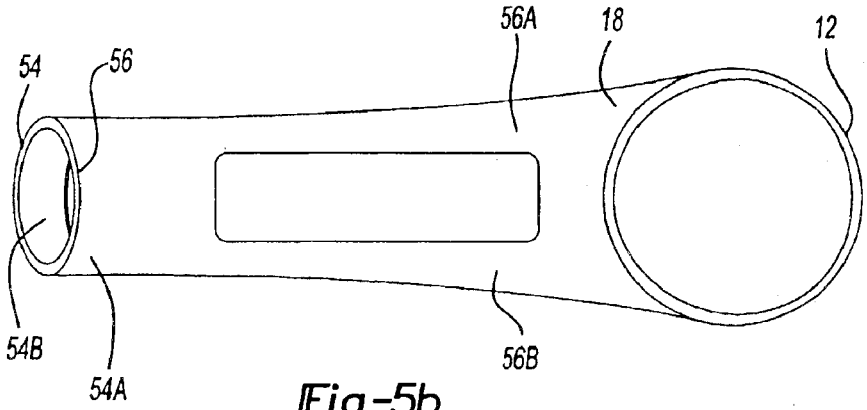
FIG. 5*b* is a bottom view of the housing of the spray head of FIG. 2.

With reference to FIGS. 5*a* and 5*b* the housing 12 includes the cover 18, the switch cover assembly 20, the rocker switch assembly 22, the sliding switch assembly 24, and the mating notch 26. The cover 18 additionally includes a shell 54, a wrap 56, and mounting surfaces 58. The shell 54 has an exterior 54*a* and an interior 54*b* and the wrap 56 has a left-side 56*a* and a right-side 56*b*. The left-side 56*a* and the right-side 56*b* of the wrap 56 are bonded to the exterior 54*a* of the shell 54.

One skilled in the art will readily appreciate that various methods exist to bond the wrap 56 to the shell 54. To that end, the method to bond or affix the wrap 56 to the shell 54 may have to withstand high humidity, excessive moisture, cleaning agents, degreasers, and skin oils. The wrap 56 must not only withstand the regime into which the spray head 10 is installed, it must also be easily be maintained in an appearance pleasing to the consumer.

The interior 54*b* of the shell 54 includes the mounting surfaces 58 (all of which are not shown) configured to abut the fluid diversion system 14, when inserted into the housing 12. The fluid diversion system 14, explained in detail below, is inserted in the housing 12 and held in place by abutting the mounting surfaces 58 so that the fluid diversion system 14 generally does not move relative to the housing 12.

Figure 6:
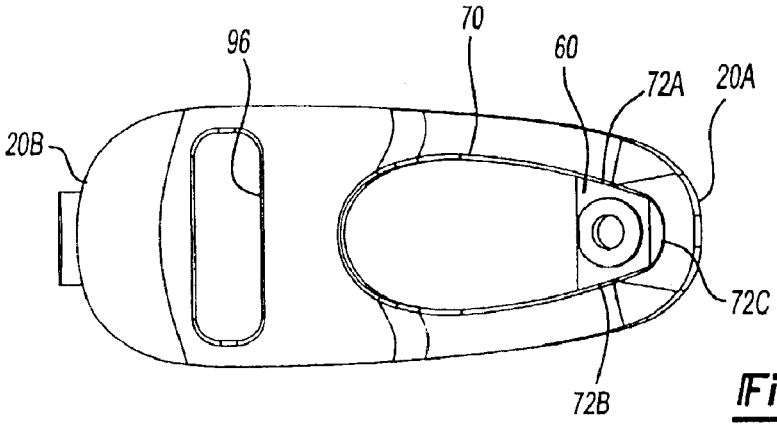
FIG. 6 is a portion of the switch cover assembly that attaches to the housing of the spray head of FIG. 2 showing the elliptical opening and the mounting member of the present invention.
Figure 7:
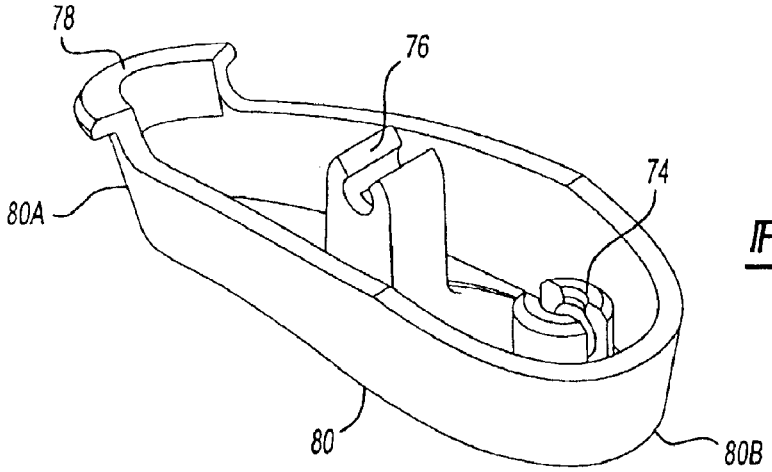
FIG. 7 is a portion of the lever switch assembly that attaches to the housing of the spray head of FIG. 2 showing portions of the bar clasp, the post clip, the tongue and the lever of the present invention.

With reference to FIGS. 2, 3, and 6, the switch cover assembly 20, which includes the rocker switch assembly 22, and the sliding switch assembly 24, forms a separate structure attached to the housing 12 after insertion of the fluid diversion system 14 into the housing 12. The switch cover assembly 20 includes an inlet end 20*a* and an outlet end 20*b*. One skilled in the art will readily appreciate that the label "inlet end" and the "outlet end" do not limit the configuration of the switch cover to a geometry having two distinct ends; one such exemplary geometry being a circle. As such, the "inlet end 20*a*" defines a portion of the switch cover assembly 20 that is relatively closer to the housing inlet 28 relative to the outlet end 20*b* being closer to the multi-pattern head 16. The labels of "inlet end" and "outlet end", therefore, do not serve to limit or define the geometry of an item, but facilitate the discussion of the item by designating its relative location. "Inlet end" and "outlet end", therefore, may be used to discuss other components of the spray head 10 with the same location-designating definition in mind.

With particular reference to FIGS. 2, 3, 6, and 7, the switch cover assembly 20 further includes a mounting member 60 defining a first aperture 62, a fastener 64, a mounting location 66 defining a second aperture 68, and an elliptical opening 70. Adjacent to the inlet end 20*a* of the switch cover assembly 20, the mounting member 60 bridges a first interior edge 72*a* to a second interior edge 72*b* of the elliptical opening 70. The fastener 64 passes through the first aperture 62 and ultimately fastens the switch cover assembly 20 to the second aperture 68 on the mounting location 66 located on the fluid diversion system 14.

The rocking switch assembly 22 includes a post clip 74, a bar clasp 76, a tongue 78, a lever 80 with a thumb depression 82, and a first spring 84. The rocking switch assembly 22 is located within the elliptical opening 70 and rocks about a pivot axis that is generally perpendicular to a longitudinal axis of the housing 12. The post clip 74 attached the lever 80 removably couples to a first exterior post 86 of the first valve assembly 34. The bar clasp 76 is also attached to the lever 80 and removably couples to a bar 88. The bar 88 is attached to a bar holder 90. The bar 88, the bar holder 90, the first exterior post 86, and the first valve assembly 34 are constituents of the fluid diversion system 14; as such, they are later discussed in further detail.

The tongue 78 is attached to the outer perimeter of an inlet end 80*a* of the lever 80. The tongue 78 is configured to fit beneath a third exterior edge 72*c* of the elliptical opening 70. An outlet end 80*b* of the lever 80 defines the thumb depression 82, which when depressed rocks the lever 80 toward the multi-pattern head 16. When the lever 80 rocks toward the multi-pattern head 16, the lever outlet end 80*b* travels downward to compress the first spring 84 and presses the first exterior post 86 into the first valve assembly 34. The lever inlet end 80*a* travels upward so that the tongue 78 contacts the third interior edge 72*c* of the elliptical opening 70.

Figure 4A:
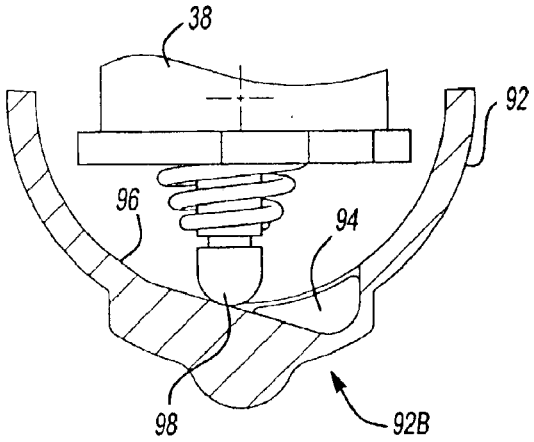
FIG. 4*a* is a front cross-sectional view of the slide of the spray head of FIG. 2 showing a portion of second exterior post and a portion of the second valve assembly in the fourth position.
Figure 4B:
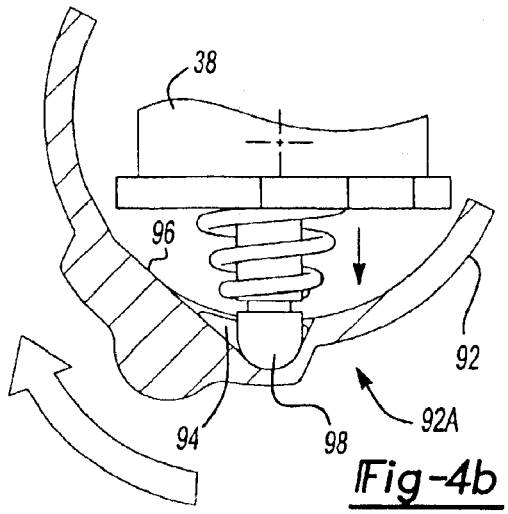
FIG. 4*b* is a front cross-sectional view of the slide of the spray head of FIG. 2 showing a portion of second exterior post and a portion of the second valve assembly in the third position.

With reference to FIGS. 2, 4*a*, and 4*b*, the sliding switch assembly 24 is located near the outlet end 20*b* of the switch cover assembly 20. The sliding switch assembly 24 further includes a slide 92 having a ramp 94, and a track 96. The slide 92 rides within the track 96. The ramp 94 formed on the slide 92 is configured to push a second exterior post 98 into the second valve assembly 38 when the slide 92 is slid from a first location 92*a* to a second location 92*b*, i.e. in a direction perpendicular to the longitudinal axis of the housing 12. The second exterior post 98 and the second valve assembly 38 are constituents of the fluid diversion system 14; as such, they are later discussed in further detail.

The faucet 50, in the preferred embodiment of the present invention, is configured to engage the mating notch 26 of the housing 12. Engagement of the mating notch 26 prevents rotation of the spray head 10 when mounted to the faucet 50. One skilled in the art will readily appreciate that the spray head 10 remains operable whether the mating notch 26 is engaged or disengaged from the faucet 50.

Figure 8:
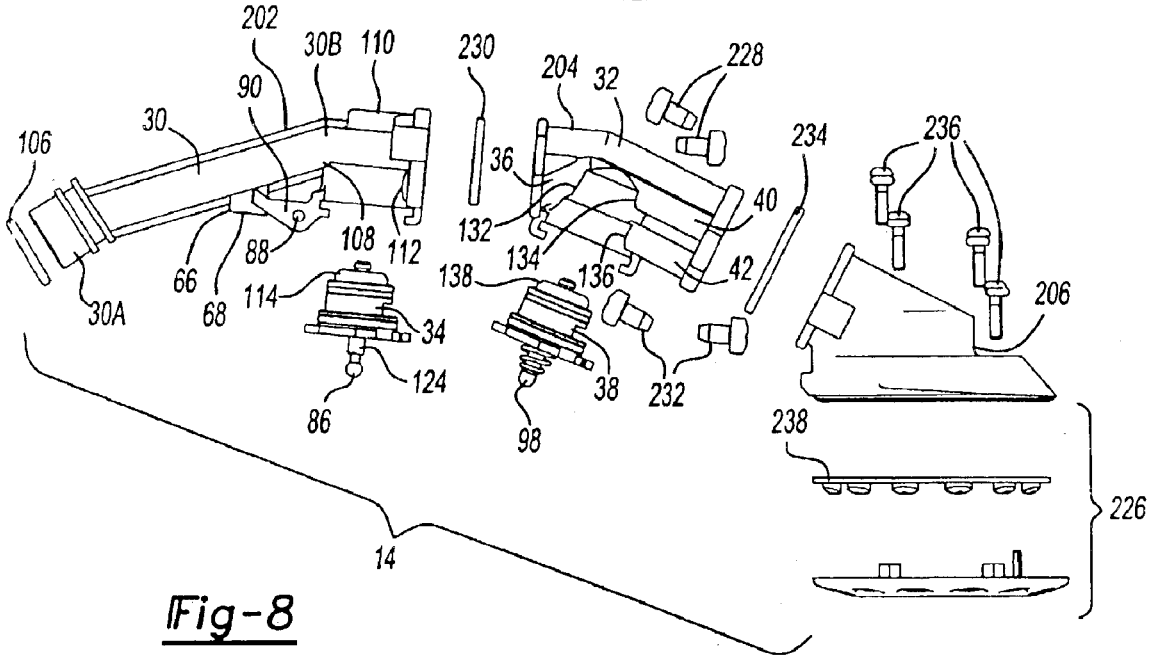
FIG. 8 is an exploded detail of the fluid diversion system of the spray head of FIG. 1 showing portions of the first structure, the second structure, the third structure, the fourth structure and the fifth structure of the present invention.

With reference now to FIGS. 3 and 8, the fluid diversion system 14 includes the housing inlet 28, the first path 30, the second path 32, the first valve assembly 34, the third path 36, the second valve assembly 38, the fourth path 40, and the fifth path 42. The first path 30 fluidly connects the housing inlet 28 to the first valve assembly 34. The second path 32 fluidly connects the first valve assembly 34 to the stream outlet assembly 44 of the multi-pattern head 16. The third path 36 fluidly connects the first valve assembly 34 to the second valve assembly 38. The fourth path 40 fluidly connects the second valve assembly 38 to the first annular outlet assembly 46 of the multi-pattern head 16. The fifth path 42 fluidly connects the second valve assembly 38 to the second annular outlet assembly 48 of the multi-pattern head 16. The stream outlet assembly 44, the first annular outlet assembly 46, and the second annular outlet assembly 48 are constituents of the multi-pattern head 16; as such, they are later discussed in further detail.

The housing inlet 28 has generally a cylindrical shape and communicates a fluid from an inlet end 28*a* to an outlet end 28*b* as seen in FIG. 3. The inlet end 28*a* is configured to connect to a conventional water supply line 100. As shown in FIG. 1, the water supply line 100 is a hose 102 of the pull-out faucet 50 that connects to the inlet end 28*a* using conventional screw threads (not shown). One skilled in the art will readily appreciate that the water supply line 100 may take many other forms; two such exemplary forms include a fixed faucet with no pull-out function (not shown) or a conventional garden hose (not shown). Furthermore, the inlet end 28*a* may be connected using other suitable connecting devices or introducing additional connecting device such as a quick-disconnect coupler (not shown).

The outlet end 28*b* of the housing inlet 28 includes a first sealing gasket 104. The outlet end 28*b* is configured to connect to an inlet end 30*a* of the first path 30 using conventional screw threads (not shown). When the housing inlet 28 is attached to the first path 30, the first sealing gasket 104 engages the interior 54*b* of the shell 54. Attachment of the housing inlet 28 to the first path 30 secures the fluid diversion system 14 within the housing 12, so that removal of the fluid diversion system 14 from the housing 12 requires removal of the housing inlet 28 from the first path 30.

The first path 30 has generally a cylindrical shape and communicates a fluid from the inlet end 30*a* to an outlet end 30*b*. The inlet end 30*a* includes a second sealing gasket 106 and connects to the outlet end 28*b* of the housing inlet 28. The outlet end 30*b* of the first path 30 is configured to connect to a first port 108 of the first valve assembly 34.

The first path 30 further includes the mounting location 66, the second aperture 68, the bar 88, and the bar holder 90. The mounting location 66 is configured so that the fastener 64 secures the switch cover assembly 20 of the housing 12 to the mounting location 66 by engaging the fastener 64 in the second aperture 68. The bar holder 90 is configured to retain the bar 88 so that the bar clasp 76 of the sliding switch assembly 24 connects to the bar 88.

Figure 9:
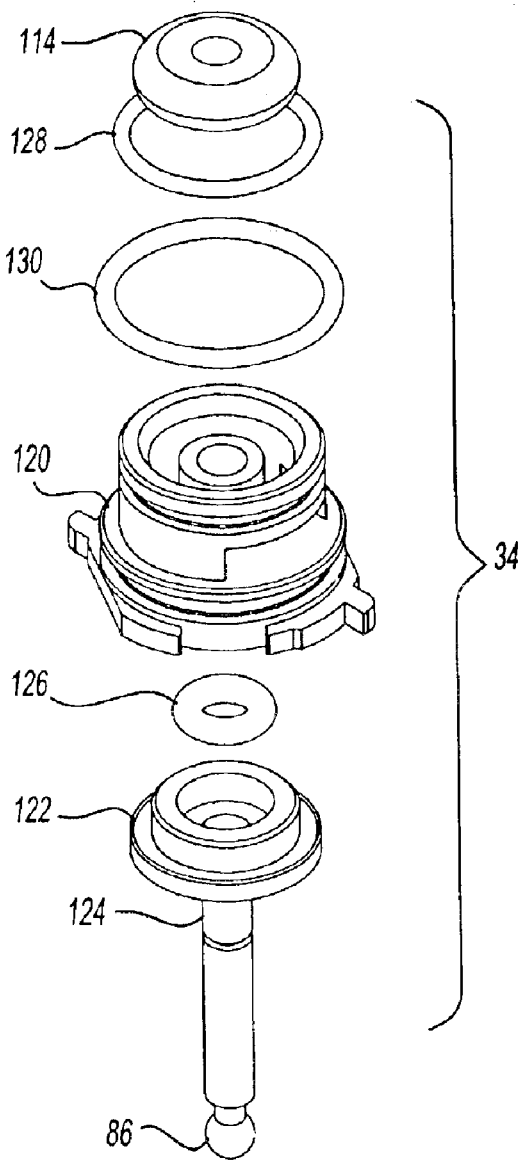
FIG. 9 is an exploded detail of the first valve assembly of the spray head of FIG. 2.
Figure 16:
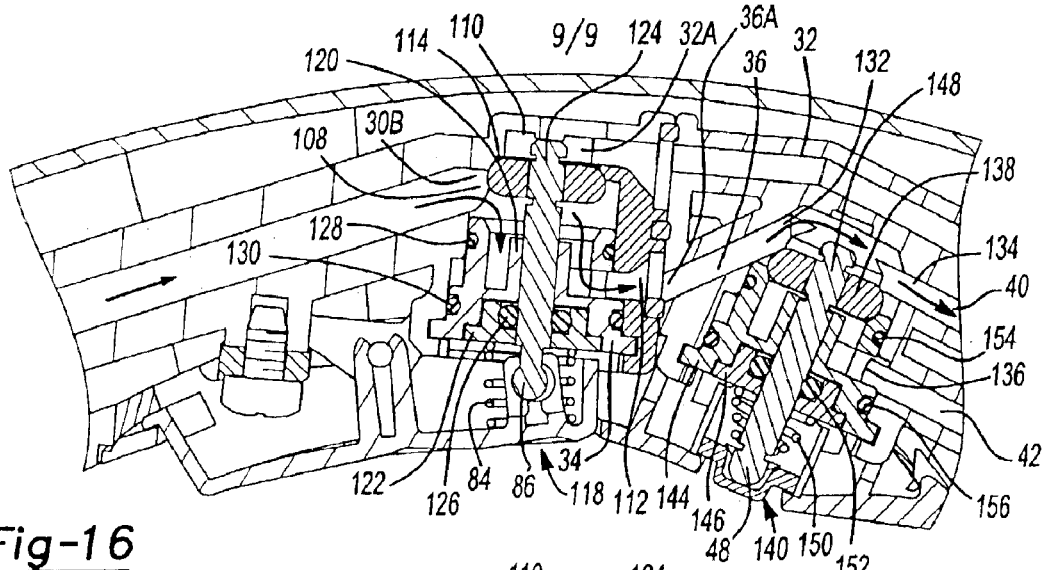
FIG. 16 is a partial side cross-sectional view of the spray head of FIG. 2 showing the first valve assembly in the second position and the second valve assembly in the third position.
Figure 17:
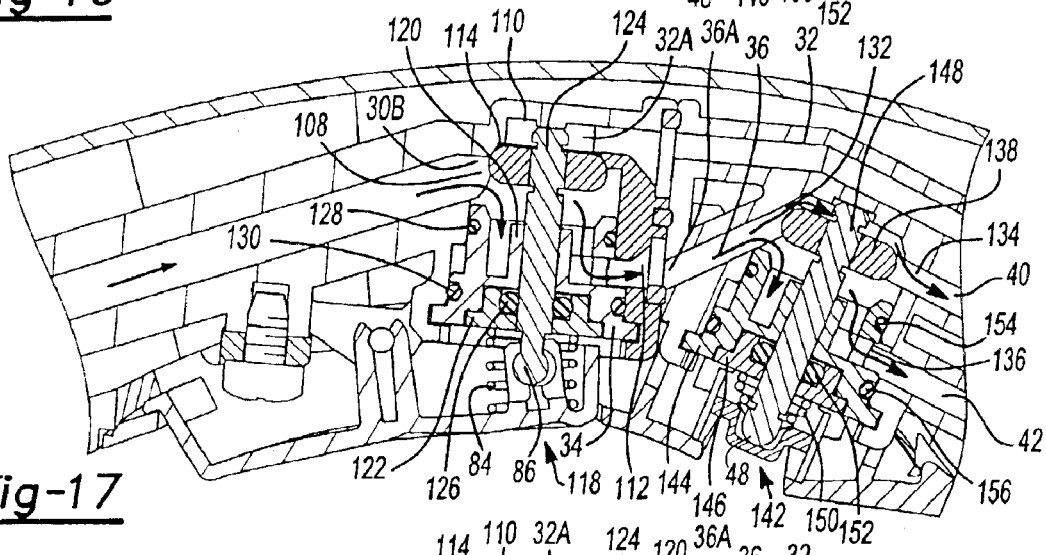
FIG. 17 is a partial side cross-sectional view of the spray head of FIG. 2 showing the first valve assembly in the second position and the second valve assembly in the fourth position.
Figure 18:
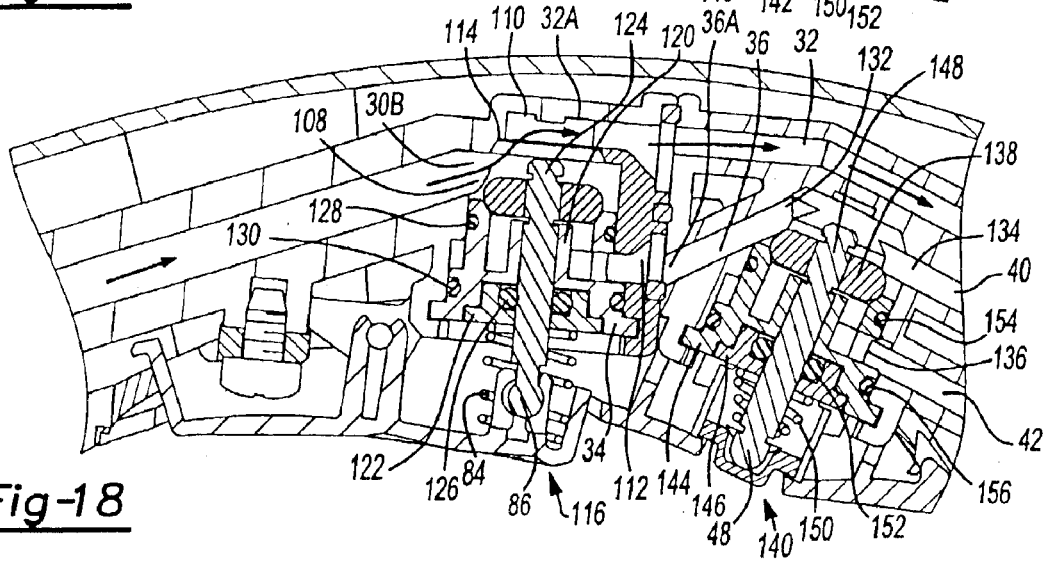
FIG. 18 is a partial side cross-sectional view of the spray head of FIG. 2 showing the first valve assembly in the first position and the second valve assembly inoperable but in the third position.

With specific reference to FIGS. 8 and 9, the first valve assembly 34 further includes the first port 108, a second port 110, a third port 112, a first sealing body 114, a first position 116 (shown in FIG. 18), a second position 118 (shown in FIGS. 16 and 17), a first body 120, the first exterior post 86, a first body cap 122, a first shaft 124, a third sealing gasket 126, a fourth sealing gasket 128, and a fifth sealing gasket 130. The first shaft 124 connects the first sealing body 114 to the first exterior post 86. The first shaft 124 passes through the first body 120, the first body cap 122, and the third sealing gasket 126. The first body cap 122 captures the third sealing gasket 126 in the first body 120. While the first sealing body 114 and the first exterior post 86 travel with the first shaft 124, the third sealing gasket 126 slidingly engages the first shaft 124 but remains captured within the first body 120.

With reference to FIGS. 9, 16, 17, and 18, movement of the first shaft 124 through the first body 120 defines the first position 116 and the second position 118 of the first valve assembly 34. The first position 116, therefore, is defined by the first sealing body 114 located in the lowermost position within the first valve assembly 34. Correspondingly, the first exterior post 86 is now relatively farther from the first body cap 122 when compared the first exterior post 86 in the second position 118. The second position 118, therefore, is defined by the first sealing body 114 located in the uppermost position within the first valve assembly 34. Correspondingly, the first exterior post 86 is now relatively closer to the first body cap 122 when compared the first exterior post 86 in the first position 116.

The first port 108 is fluidly connected to the outlet end 30*b* of the first path 30; as such, the first port 108 is configured so that fluid enters the first valve assembly 34 through the first port 108. In turn, the second port 110 and the third port 112 are configured so that fluid exits the first valve assembly 34 from either the second port 110 or the third port 112 depending on the position of the first valve assembly 34. The second port 110 is connected to an inlet end 32*a* of the second path 32. The third port 112 is connected to an inlet end 36*a* of the third path 36.

In the first position 116, the first valve assembly 34 is configured so that the fluid enters the first valve assembly 34 through the first port 108 and exits through the second port 110. As such, the first sealing body 114 in the first position 116 seals the third port 112. In the second position 118, the first valve assembly 34 is configured so that the fluid enters the first valve assembly 34 through the first port 108 and exits through the third port 112. As such, the first sealing body 114 in the second position 118 seals the second port 110.

The first valve assembly 34 is additionally configured so that forces exerted by fluid pressure within the spray head 10 maintain the first valve assembly 34 in the first position 116. In addition to the forces exerted by the fluid within the spray head 10, the first spring 84 is configured to maintain the first valve assembly 34 in the first position 116.

The first spring 84 is disposed between the first body cap 122 and the lever 80 of the sliding switch assembly 24. Disposed within the first spring 84 is the first exterior post 86 to which the post clip 74 of the lever 80 is attached. Pressing the lever 80 compresses the first spring 84 and drives the first shaft 124 to its uppermost position within the first valve assembly 34 causing the first valve assembly 34 to change from the first position 116 to the second position 118. With the lever 80 no longer pressed, the first spring 84 returns to its normal position; such that, the lever 80 moves away from the first body cap 122. To that end, the post clip 74 of the lever 80 pulls on the first exterior post 86, which results in the first shaft 124 returning to its lowermost position. Thus, with the lever 80 no longer pressed the first valve assembly 34 returns to the first position 116.

The first body 120 is configured such that it is an independent component of the first valve assembly 34 and can be inserted and removed as needed. This configuration allows for installation, servicing and inspecting the components of the first valve assembly 34. The fourth sealing gasket 128 and the fifth sealing gasket 130 are seated along the periphery of the first body 120 and serve to seal the first body 120 within the first valve assembly 34 when installed.

Figure 12:
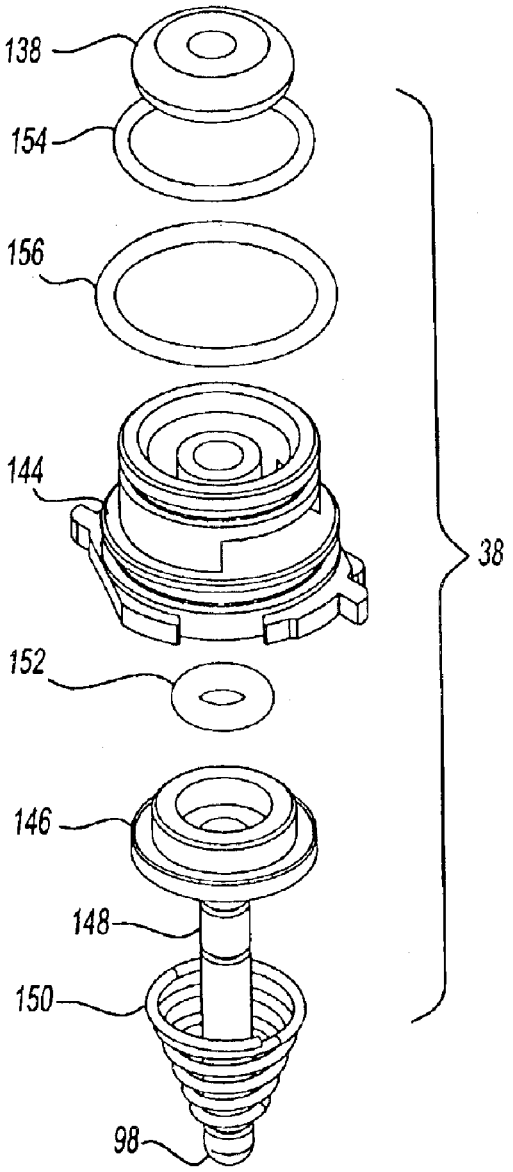
FIG. 12 is an exploded detail of the second valve assembly of the spray head of FIG. 2.
Figure 10:
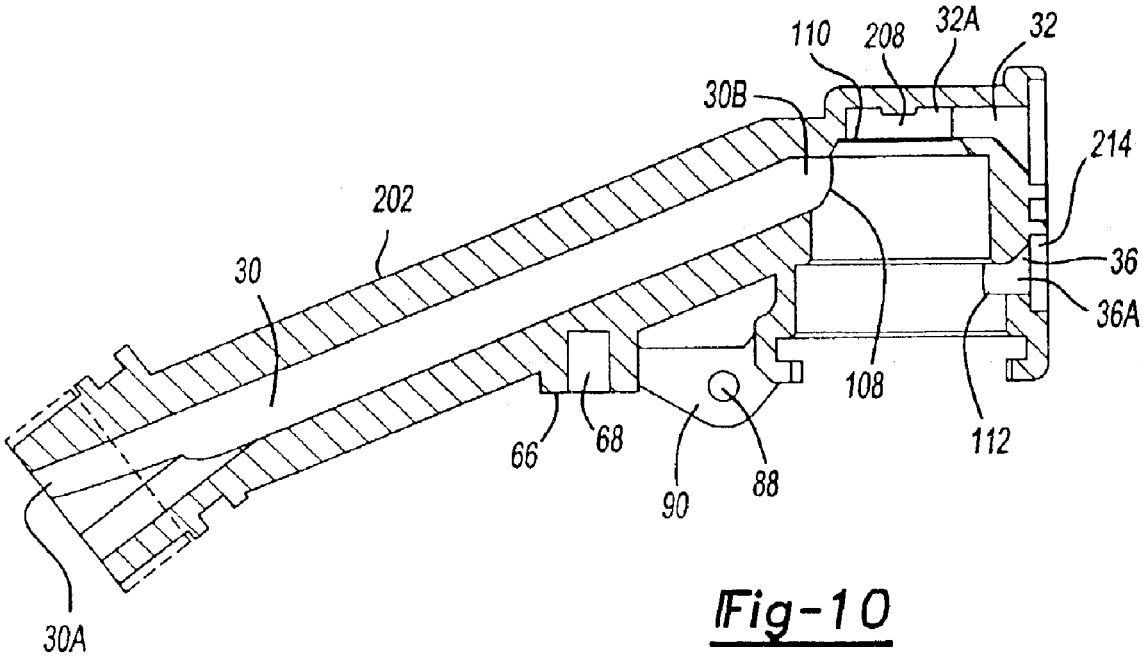
FIG. 10 is a cross-sectional view of the second structure of the spray head of FIG. 2 showing portions of the first valve assembly, the first path, the second path, and the third path of the present invention.
Figure 11:
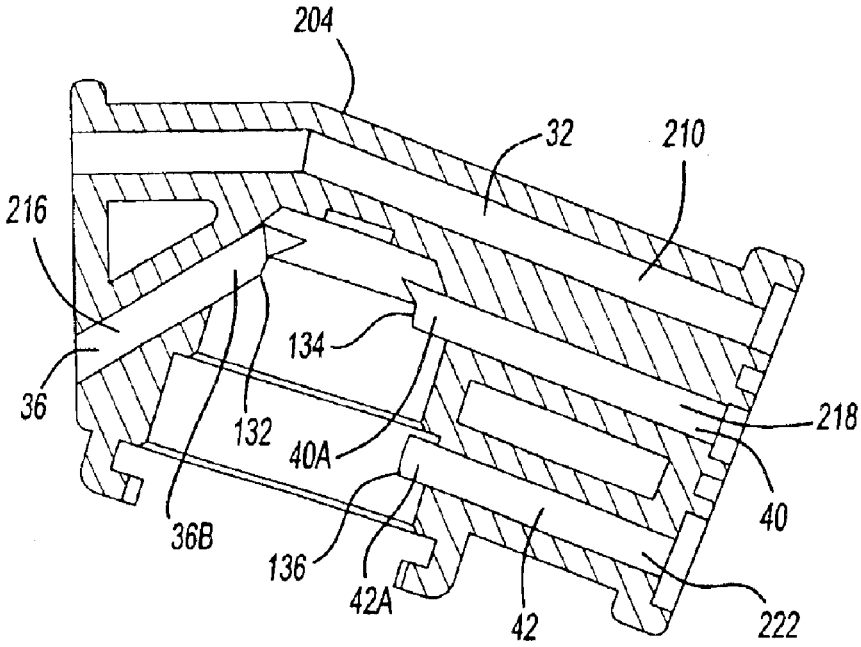
FIG. 11 is a cross-sectional view of the third structure of the spray head of FIG. 2 showing portions of the second path, the third path, the fourth path, the fifth path, and the second valve assembly of the present invention.
Figure 13:
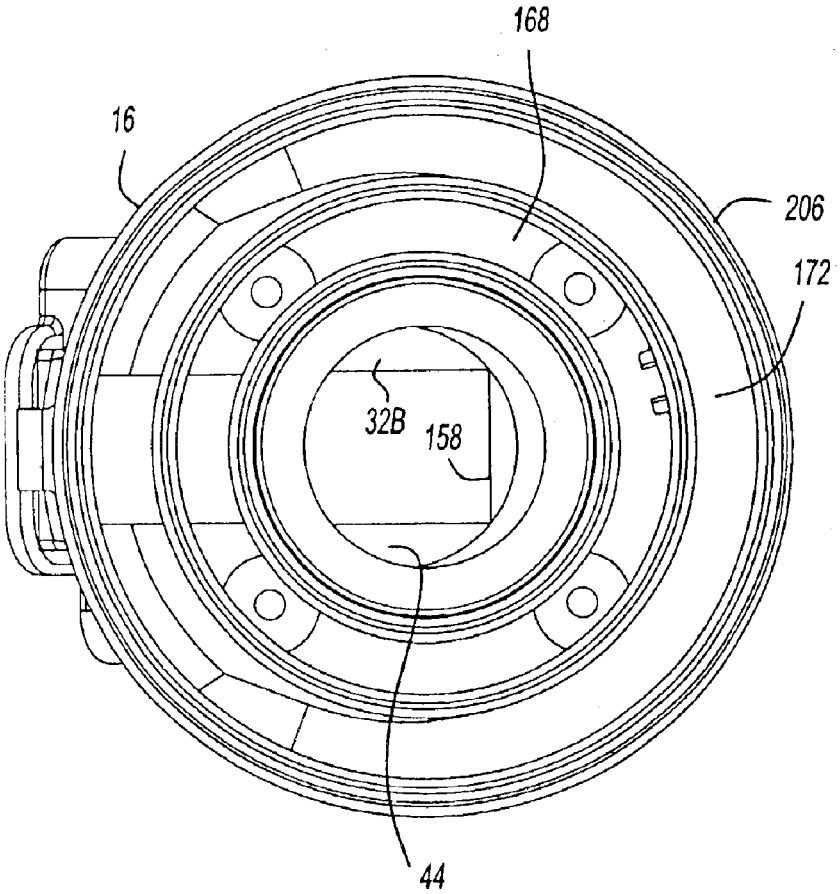
FIG. 13 is a bottom view of the multi-pattern head of the spray head of FIG. 2 showing portions of the reservoir, the first annular outlet assembly, and the second annular outlet assembly of the present invention.
Figure 14A:
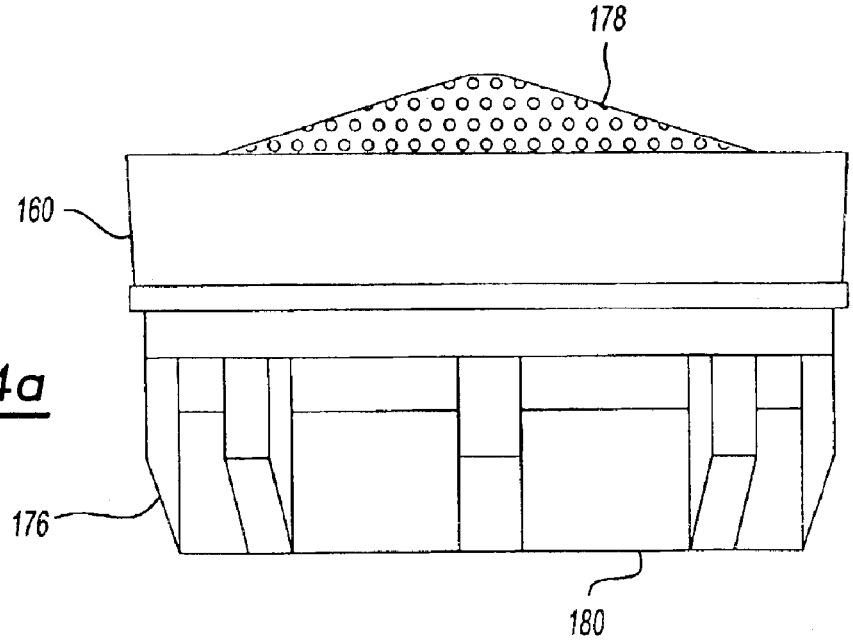
FIG. 14*a* is a side view of the aerator assembly of the spray head of FIG. 2.
Figure 14B:
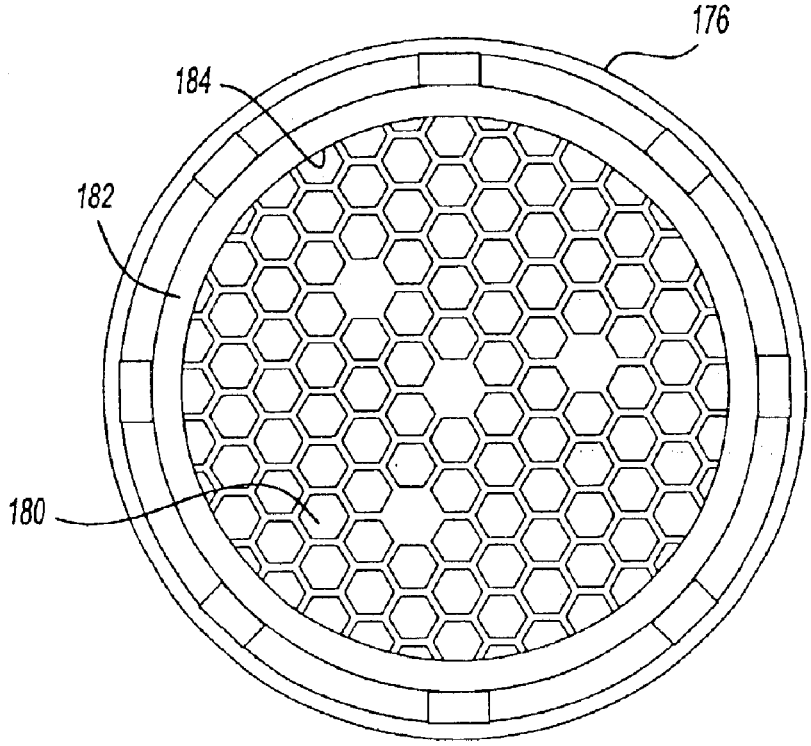
FIG. 14*b* is a side view of the aerator assembly of the spray head of FIG. 2 showing a portion of the aerator screen of the present invention.
Figure 15:
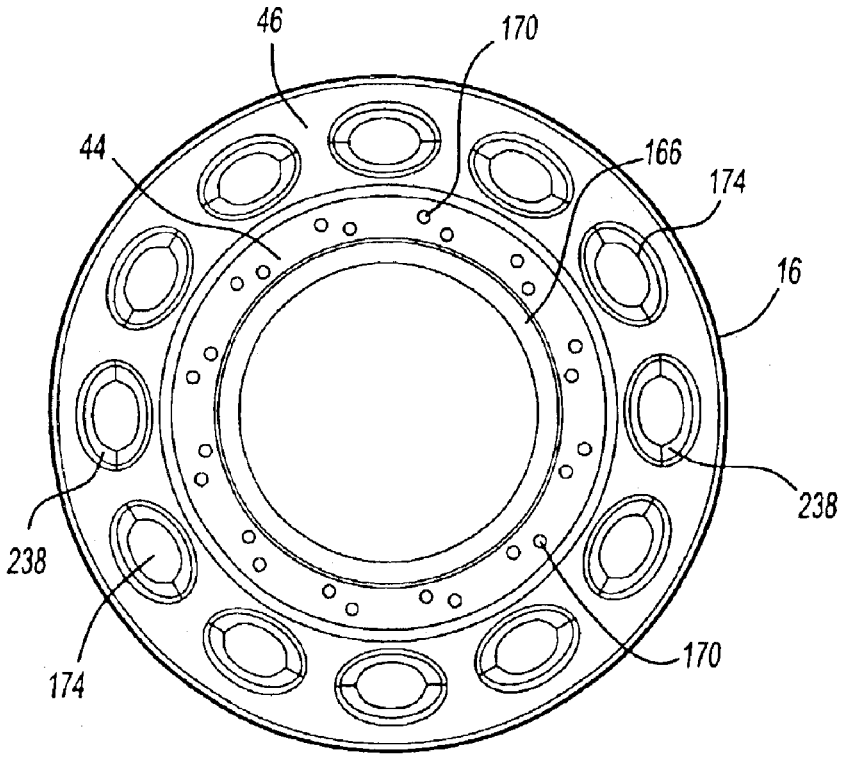
FIG. 15 is a front view of the multi-pattern head of the spray head of FIG. 2 showing portions of the stream outlet assembly, the first annular outlet assembly, and the second annular outlet assembly of the present invention.

With specific reference to FIGS. 10, 11, and 12, the second path 32 has generally a bent cylindrical shape and communicates a fluid from the inlet end 32*a* to an outlet end 32*b*. The bent cylindrical shape of the second path 32 generally follows the contours of the housing 12 between the inlet end 32*a* and the outlet end 32*b*. The inlet end 32*a* connects to the second port 110 of the first valve assembly 34. The outlet end 32*b* connects to the stream outlet assembly 44 of the multi-pattern head 16.

The third path 36 has generally a cylindrical shape and communicates a fluid from the inlet end 36*a* to an outlet end 36*b*. The inlet end 36*a* connects to the third port 112 of the first valve assembly 34. The outlet end 36*b* connects to a fourth port 132 of the second valve assembly 38.

With reference to FIGS. 11, 12, 16, 17, and 18, the second valve assembly 38 further includes the fourth port 132, a fifth port 134, a sixth port 136, a second sealing body 138, a third position 140, a fourth position 142, a second valve body 144, the second exterior post 98, a second body cap 146, a second shaft 148, a second spring 150, a sixth sealing gasket 152, a seventh sealing gasket 154, and a eighth sealing gasket 156. The second shaft 148 connects the second sealing body 138 to the second exterior post 98. The second shaft 148 passes through the second valve body 144, the second body cap 146, and the sixth sealing gasket 152. The second body cap 146 captures the sixth sealing gasket 152 in the second valve body 144. While the second sealing body 138 and the second exterior post 98 travel with the second shaft 148, the sixth sealing gasket 152 slidingly engages the second shaft 148 but remains captured within the second valve body 144.

Movement of the second shaft 148 through the second valve body 144 defines the third position 140 and the fourth position 142. The third position 140, therefore, is defined by the second sealing body 138 located in the lowermost position within the second valve assembly 38. Correspondingly, the second exterior post 98 is now relatively farther from the second body cap 146 when compared the second exterior post 98 in the fourth position 142. The fourth position 142, therefore, is defined by the second sealing body 138 located in the uppermost position within the second valve assembly 38. Correspondingly, the second exterior post 98 is now relatively closer to the second body cap 146 when compared the second exterior post 98 in the third position 140.

The fourth port 132 is fluidly connected to the outlet end 36*b* of the third path 36; as such, the fourth port 132 is configured so that fluid enters the second valve assembly 38 through the fourth port 132. In turn, the fifth port 134 and the sixth port 136 are configured so that fluid exits the second valve assembly 38 from either the fifth port 134, the sixth port 136, or both the fifth port 134 and the sixth port 136 depending on the position of the second valve assembly. The fifth port 134 is connected to an inlet end 40*a* of the fourth path 40. The sixth port 136 is connected to an inlet end 42*a* of the fifth path 42.

In the third position 140, the second valve assembly 38 is configured so that the fluid enters the second valve assembly 38 through the fourth port 132 and exits through the fifth port 134. As such, the second sealing body 138 seals the sixth port 136. In the fourth position 142, the second valve assembly 38 is configured so that the fluid enters the second valve assembly 38 through the fourth port 132 and exits through both the fifth port 134 and the sixth port 136. As such, the second sealing body 138 neither seals the fourth port 132, the fifth port 134, nor the sixth port 136.

The second valve assembly 38 is configured so that forces exerted by fluid pressure within the spray head 10 maintain the second valve assembly 38 in the third position 140. In addition to the forces exerted by the fluid within the spray head 10, the second spring 150 is configured to maintain the second valve assembly 38 in the third position 140.

The second spring 150 is attached to an end 98*a* of the second exterior post 98 and, thus, disposed between the second body cap 146 and the second exterior post 98. The ramp 94 of the slide 92 is configured so that moving the slide 92 from the first location 92*a* to the second location 92*b* compresses the second spring 150 and drives the second shaft 148 to its uppermost position within the second valve assembly 38. As such, the second valve assembly 38 changes from the third position 140 to the fourth position 142, when the slide 92 is moved from the first location 92*a* to the second location 92*b*. Moving the rocker switch from the second location 92*b* back to the first location 92*a* allows the second spring 150 to return to its normal position thereby pushing the second exterior post 98 away from the second body cap 146. The second valve assembly 38, therefore, returns to the third position 140.

The second valve body 144 is configured such that it is an independent component of the second valve assembly 38 and can be inserted and removed as needed. This configuration allows for installation, servicing and inspecting the components of the second valve assembly 38. The seventh sealing gasket 154 and the eighth sealing gasket 156 are seated along the periphery of the second valve body 144 and serve to seal the second valve body 144 within the second valve assembly 38 when installed.

The fourth path 40 has generally a bent cylindrical shape and communicates a fluid from the inlet end 40*a* to an outlet end 40*b*. The bent cylindrical shape of the second path 32 generally follows the contours of the housing 12 between the inlet end 40*a* and the outlet end 40*b*. The inlet end 40*a* connects to the fifth port 134 of the second valve assembly 38. The outlet end 40*b* connects to the first annular outlet assembly 46 of the multi-pattern head 16.

The fifth path 42 has generally a cylindrical shape and communicates a fluid from the inlet end 42*a* to an outlet end 42*b*. The inlet end 42*a* connects to the sixth port 136 of the second valve assembly 38. The outlet end 42*b* connects to the second annular outlet assembly 48 of the multi-pattern spray head 16. As noted above, when the second valve assembly 38 is in the fourth position 142 fluid is flowing through the fifth path 42 and through the fourth path 40.

As described above, the present invention utilizes two valve assemblies for selecting the mode of operation of the spray head. Specifically, the first valve assembly 34 is operable to select between a stream mode and a spray mode, while the second valve assembly 38 is operable to modify the spray mode from a single patterned spray mode to a multiple patterned spray mode. However, one skilled in the art will recognize that the present invention may be adapted to provide other modes of operation. For example, the first valve assembly could employ a multiple position (i.e., more than two) valve to provide a stream/spray mode or an off mode. Likewise, the second valve assembly could be designed to provide different spray modes based on the selected position. Moreover, additional valve assemblies could be incorporated into the spray handle to increase the number of modes available from the spray head. Various flow paths or ports could also incorporate throttling to configure the flow pressure and flow rate of the fluid traveling therethrough. The present invention contemplates the above described modifications.

With reference to FIGS. 2 and 13–15, the multi-pattern head 16 includes the stream outlet assembly 44, the first annular outlet assembly 46, and the second annular outlet assembly 48. The stream outlet assembly includes a reservoir 158, an aerator assembly 160, a ninth sealing gasket 162, a tenth sealing gasket 164, and a retaining lug 166. The aerator assembly 160 of the stream outlet assembly 44 further includes an aerator housing 176, a first screen 178, a second screen 180, a screen ring 182, and a groove 184. The first annular outlet assembly 46 includes a first annular channel 168 and a plurality of holes 170. The second annular outlet assembly 48 includes a second annular channel 172 and a plurality of orifices 174.

The outlet end 32*b* of the second path 32 of the fluid diversion system 14 connects to the reservoir 158 of the stream outlet assembly 44. The aerator assembly 160 is configured to connect to the reservoir 158; such that, the retaining lug 166 is rotated into the multi-pattern head 16 and secures the aerator assembly 160 and the ninth sealing gasket 162 to the reservoir 158. The tenth sealing gasket 164 is disposed within the multi-pattern head 16 and configured to engage the retaining lug 166 when the retaining lug 166 is rotated to secure the aerator assembly 160 into the multi-pattern head 16.

The aerator housing 176 contains the first screen 178 above the second screen 180. The second screen 180 is contained within the screen ring 182 that defines the groove 184 and spins within the groove 184. Flow through the stream outlet assembly 44 is characterized by a stream of fluid, most notably water, emitted in generally a column-shaped stream. One skilled in the art will readily appreciate the fact that pre-fabricated aerator assembly from a suitable vendor may be used or an assembly of screens can be configured within the multi-pattern head 16 to effectuate the same style of flow noted above. The aerator assembly 160 of the preferred embodiment of the present invention is supplied by Neoperl of Waterbury, Conn. Whether pre-fabricated as a single unit or assembled from multiple components and secured within the multi-pattern head 16, the aerator assembly is easily removed and installed to facilitate repair and maintenance of the stream outlet assembly 44.

The first annular ring includes the first annular channel 168 and the plurality of holes 170. The outlet end 40*b* of the fourth path 40 fluidly connects to the first annular channel 168 of the first annular outlet assembly 46. Fluid flows from the fourth path 40 and at least partially fills the first annular channel 168. The fluid then exits the multi-pattern head 16 through the plurality of holes 170.

In the preferred embodiment of the present invention, the plurality of holes 170 are twenty-four holes arranged in pairs in an annular pattern around the stream outlet assembly 44. The diameter of the holes are about 0.036 inches (about 0.92 mm) and are configured to deliver a higher velocity spray when compared to fluid flowing through both the first annular outlet assembly 46 and the second annular outlet assembly 48. The fluid exits the plurality of holes 170 in spray columns that are individually perceivable when compared to the column of flow from the stream outlet assembly 44. The higher velocity spray may be perceived as a harder spray and may further assist the user with tasks that require a harder and higher velocity spray (not shown).

The second annular outlet assembly 48 includes the second annular channel 172 and the plurality of orifices 174. The outlet end 42*b* of the fifth path 42 fluidly connects to the second annular channel 172 of the second annular outlet assembly 48. Fluid flows from the fifth path 42 and at least partially fills the second annular channel 172. The fluid then exits the multi-pattern head 16 through the plurality of orifices 174.

In the preferred embodiment of the present invention, the plurality of orifices 174 are twelve orifices about equally spaced in an annular pattern around the stream outlet assembly 44. The orifices have an oval shape with a first diameter of about 0.202 inches (about 5.13 mm) and a second diameter of about 0.130 inches (about 3.30 mm). The orifices are configured to deliver a lower velocity spray when compared to fluid flowing from the first annular outlet assembly 46. The fluid exits the plurality orifices 174 in spray columns that are individually perceivable when compared to the column of flow from the stream outlet assembly 44. The lower velocity spray may be perceived as a softer spray and may further assist the user with tasks that require a softer and lower velocity spray (not shown).

With general reference to all of the Figures, the spray head 10, constructed according to the preferred embodiment of the present invention, is constructed with multiple structures or modules, which are fabricated and assembled to produce the spray head 10. As such, the spray head 10 includes the housing 12 and a first module 200, a second module 202, a third module 204, a fourth module 206, and a fifth module 226. The first module 200 includes the housing inlet 28. The second module 202 includes the first path 30, the first valve assembly 34, a first section 208 of the second path 32, and a fourth section 214 of the third path 36. The third module 204 includes a second section 210 of the second path 32, a fifth section 216 of the third path 36, the second valve assembly 38, a sixth section 218 of the fourth path 40, and an eighth section 222 of the fifth path 42. The fourth module 206 includes a third section 212 of the second path 32, a seventh section 220 of the fourth path 40, a ninth section 224 of the fifth path 42, the reservoir 158, the first annular channel 168, and the second annular channel 172. The fifth module 226 includes the aerator assembly 160, the plurality of holes 170, and the plurality of orifices 174.

The second path 32, therefore, includes the first section 208, the second section 210 and the third section 212. The third path 36, therefore, includes the fourth section 214 and the fifth section 216. The fourth path 40, therefore, includes the sixth section 218 and the seventh section 220. The fifth path 42, therefore, includes the eighth section 222 and the ninth section 224.

The first module 200 is attached to the second module 202 using conventional screw threads (not shown). When the first module 200 is rotated and secured onto the second module 202, the first module 200 engages the second sealing gasket 106; thus, sealing the second module 202 to the first module 200.

The second module 202 is secured to the third module 204 by a first set of fasteners 228. Between the second module 202 and the third module 204 is a tenth sealing gasket 230. The tenth sealing gasket 230 is a unitary seal that is configured to seal around the second path 32 and the third path 36. The tenth sealing gasket 230, therefore, not only seals the second module 202 to the third module 204, it also seals the second path 32 and the third path 36 to prevent fluid communication between the two.

The third module 204 is secured to the fourth module 206 by a second set of fasteners 232. Between the third module 204 and the fourth module 206 is an eleventh sealing gasket 234. The eleventh sealing gasket 234 is a unitary seal that is configured to seal around the second path 32, the fourth path 40, and the fifth path 42. The eleventh sealing gasket 234, therefore, not only seals the third structure 204 to the fourth structure 206, it also seals the second path 32, the fourth path 40, and the fifth path 42 to prevent fluid communication between the three.

The fourth module 206 is secured to the fifth module 226 by a third set of fasteners 236. Between the fourth module 206 and the fifth module 226 is a twelfth sealing gasket 238. The twelfth sealing gasket 238 is a unitary seal that is configured to seal around the reservoir 158, the first annular channel 168 and the second annular channel 172. The twelfth sealing gasket 238, therefore, not only seals the fourth module 206 to the fifth module 226, it is also configured to seal the reservoir 158 to the aerator assembly 160. The twelfth sealing gasket 238 is further configured to seal the first annular channel 168 to the plurality of holes 170 and seal the second annular channel 172 to the plurality of orifices 174. The twelfth sealing gasket 238 also partially forms the plurality of orifices 174.

With general reference to all the Figures, the spray head 10, constructed according to the preferred embodiment of the present invention, is constructed with multiple flow paths, in which two valves are disposed. As such, the spray head 10 includes the housing 12, an inlet 250, a first flow path 252, a second flow path 254, and a third flow path 256. The inlet 250 includes a portion of the housing inlet 28. The first flow path 252 includes a portion of the housing inlet 28, the first path 30, the first valve assembly 34, the second path 32, and the stream outlet assembly 44. The second flow path includes a portion of the housing inlet 28, the first path 30, the first valve assembly 34, the third path 36, the second valve assembly 38, the fourth path 40, and the first annular outlet assembly 46. The third flow path includes a portion of the housing inlet 28, the first path 30, the first valve assembly 34, the third path 36, the second valve assembly 38, the fifth path 42, and the second annular outlet assembly 48.

The first flow path 252, therefore, fluidly connects the inlet 250 with the stream outlet assembly 44. The second flow path 254, therefore, fluidly connects the inlet 250 with the first annular outlet assembly 46. The third flow path 256, therefore, fluidly connects the inlet 250 with the second annular outlet assembly 46. In addition, the housing inlet 28 and the first path 30 may be referred to as an inlet, which would indicate the fluid path from the inlet 250 to the first valve assembly 34. The third path 36 may also be referred to as an intermediate flow path, which would indicate the fluid path from the first valve assembly 34 to the second valve assembly 38. Furthermore, first position 116 may be referred to as first mode and as such, the various positions of the first and second valves may be referred to as modes.

The description of the invention is merely exemplary in nature and, thus, variations that do not depart from the gist of the invention are intended to be within the scope of the invention. The invention is now defined by the claims below.

What is claimed is:

1. A faucet head comprising:

a housing having a housing inlet, an intermediate flow path, a first outlet flow path, a second outlet flow path and a third outlet flow path;

a first valve operable in a first mode to enable fluid communication between the housing inlet and the first outlet flow path and operable in a second mode to enable fluid communication between the housing inlet and the intermediate flow path, the first valve having a first spring biasing the first valve in the first mode;

a second valve operable in a third mode to enable fluid communication between the intermediate flow path and the second outlet flow path when the first valve is in the second mode, the second valve operable in a fourth mode to enable fluid communication between the intermediate flow path and the second and third outlet flow paths simultaneously when the first valve is in the second mode, said second valve being inoperable when said first valve is in said first mode; and a spray head having a first outlet in fluid communication with the first outlet flow path, a second outlet in fluid communication with the second flow path and a third outlet in fluid communication with the third outlet flow path.

2. The faucet head of claim 1, wherein the first outlet comprises an aerator assembly.

3. The faucet head of claim 1, wherein the second outlet comprises an annular outlet assembly.

4. The faucet head of claim 3, wherein the annular outlet assembly defines a plurality of apertures adapted to produce a high velocity spray.

5. The faucet head of claim 3, wherein the third outlet comprises a second annular outlet assembly.

6. The faucet head of claim 5, wherein the second annular outlet assembly defines a plurality of orifices, the plurality of orifices in combination with the plurality of apertures adapted to produce a low velocity spray.

7. The faucet head of claim 1, wherein the second valve further includes a second spring biasing the second valve in the third mode.

8. A pull-out head of the type having a housing and a fluid diversion system, said fluid diversion system comprising:

a first flow path formed in said housing to provide fluid communication from an inlet to a first outlet;

a first valve interposed in said first flow path between said inlet and said first outlet, the first valve having a first spring biasing the first valve in a first position;

a second flow path formed in said housing to provide fluid communication from said first valve to a second outlet;

a second valve interposed in said second flow path between said first valve and said second outlet;

a third flow path formed in said housing to provide fluid communication from said second valve to a third outlet;

wherein said first valve is operable in a first position to provide fluid communication from said inlet through said first flow path to said first outlet and a second position to provide fluid communication from said inlet to said second flow path; and wherein said second valve independent from said first valve is operable in a third position to provide fluid communication from said first valve to said second outlet through said second flow path and a fourth position to provide fluid communication from said first valve through said third flow path to said third outlet.

9. The pull-out head of claim 8 wherein said first outlet comprises an aerator assembly.

10. The pull-out head of claim 8 wherein said second outlet comprises a plurality of apertures formed in said housing in a generally circular arrangement.

11. The pull-out head of claim 10 wherein said third outlet comprises a plurality of apertures formed in said housing in a generally circular arrangement.

12. The faucet of claim 8, wherein the second valve further includes a second spring, the second spring biasing the second valve in the third position.

13. The faucet of claim 8, wherein the first valve is configured so that a fluid pressure in the faucet maintains the first valve in the first position and wherein the second valve is configured so that a fluid pressure in the faucet maintains the second valve in the third position.

14. A faucet comprising:

a faucet body having a flow control valve assembly operable to provide temperature control and flow regulation of a fluid;

a pull-out head adapted to be displaced from said faucet body, said pull-out head including:

a housing;

a first component releaseably secured in said housing and in fluid communication with said flow control valve, said first component including a first valve element movable between a first position and a second position; wherein the first valve is spring biased to the first position, a second component releaseably secured in said housing and in fluid communication with said first component, said second component having a second valve element moveable between a third position and a fourth position;

a multi-pattern head disposed in said housing and in fluid communication with said second component, said multi-pattern head having a stream outlet, a first spray outlet and a second spray outlet;

wherein said pull-out head is operable in a stream mode for emitting said fluid from said stream outlet when said first valve element is in said first position, a first spray mode for emitting said fluid from said first spray outlet when said first valve element is in said second position and said second valve element is in said third position and a second spray mode for emitting said fluid from said second spray outlet when said first valve element is in said second position and said second valve element is in said fourth position.

15. The faucet of claim 14 wherein said pull-out head further comprises an inlet component releaseably secured in said housing and providing fluid communication between said flow control valve and said first module.

16. The faucet of claim 14 wherein said pull-out head further comprises an outlet component releaseably secured in said housing and providing fluid communication between said second module and said multi-pattern head.

17. The faucet of claim 14 further comprising a flexible hose interconnecting said flow control valve and said pull-out head to permit said pull-out head to be displaced from said faucet body.

18. The faucet of claim 14 wherein said pull-out head is operable in said second spray mode to emit said fluid from said first and second spray outlets when said first valve element is in said second position and said second valve element is in said fourth position.

19. The faucet of claim 14 further comprising a first switch supported for rocking movement in said housing, said first switch coupled to said first valve to move said first valve element between said first position and said second position.

20. The faucet of claim 19 wherein said housing has a longitudinal axis and said first switch rocks about a pivot axis generally perpendicular to said longitudinal axis.

21. The faucet of claim 14 further comprising a second switch supported for sliding movement in said housing, said second switch coupled to said second valve to move said second valve element between said third position and said fourth position.

22. The faucet of claim 21 wherein said housing has a longitudinal axis and said second switch sliding within said housing about an axis generally perpendicular to said longitudinal axis.

23. A method of operating a pull-out head of a faucet in multiple modes, the method comprising:

manipulating a first valve to a first position to emit water from a stream outlet in a stream mode; wherein the first valve is spring biased to be in the stream mode;

manipulating said first valve to a second position to emit water from a first spray outlet in a first spray mode when a second valve is in a third position; and manipulating said second valve to a fourth position when said first valve is in said second position to emit water from a second spray outlet in a second spray mode.

24. The method of operating a pull-out head of a faucet of claim 23 wherein manipulating said second valve to said fourth position emits water from said first and second spray outlets in said second spray mode.

25. A faucet comprising:

a housing, adapted to be manipulated by a user;

a first module adapted to connect to a water supply a second module having a first valve switchable between a first position and a second position;

a third module having a second valve switchable between a third position and a fourth position;

a fourth module;

a multi-pattern head adapted to emit a fluid; the multi-pattern head having a first pattern output, a second pattern output and a third pattern output;

the second module fluidly connects the first module to the third module;

the fourth module fluidly connects the third module to the multi-pattern head;

the first valve in the first position fluidly communicating the fluid to the first pattern output;

the first valve in the second position fluidly communicating the fluid to one of the second pattern output, the third pattern output, or combinations thereof;

the second valve in the third position fluidly communicating the fluid to the second pattern output; and the second valve in the fourth position fluidly communicating the fluid to the second pattern output and the third pattern output.

26. The faucet of claim 25, wherein the first module removably secures to the second module to secure said first module and said second module in said housing.

27. A faucet head comprising:

a housing having a housing inlet, an intermediate flow path, a first outlet flow path, a second outlet flow path and a third outlet flow path;

a first valve operable in a first mode to enable fluid communication between the housing inlet and the first outlet flow path and operable in a second mode to enable fluid communication between the housing inlet and the intermediate flow path;

a second valve operable in a third mode to enable fluid communication between the intermediate flow path and the second outlet flow path when the first valve is in the second mode, the second valve operable in a fourth mode to enable fluid communication between the intermediate flow path and the second and third outlet flow paths simultaneously when the first valve is in the second mode, the second valve being inoperable when said first valve is in said first mode, wherein the second valve further includes a second spring biasing the second valve in the third mode; and a spray head having a first outlet in fluid communication with the first outlet flow path, a second outlet in fluid communication with the second flow path and a third outlet in fluid communication with the third outlet flow path.

28. A pull-out head of the type having a housing and a fluid diversion system, said fluid diversion system comprising:

a first flow path formed in said housing to provide fluid communication from an inlet to a first outlet;

a first valve interposed in said first flow path between said inlet and said first outlet;

a second flow path formed in said housing to provide fluid communication from said first valve to a second outlet;

a second valve interposed in said second flow path between said first valve and said second outlet wherein the second valve further includes a second spring, the second spring biasing the second valve in the third position;

a third flow path formed in said housing to provide fluid communication from said second valve to a third outlet;

wherein said first valve is operable in a first position to provide fluid communication from said inlet through said first flow path to said first outlet and a second position to provide fluid communication from said inlet to said second flow path; and wherein said second valve independent from said first valve is operable in a third position to provide fluid communication from said first valve to said second outlet through said second flow path and a fourth position to provide fluid communication from said first valve through said third flow path to said third outlet.

29. A pull-out head of the type having a housing and a fluid diversion system, said fluid diversion system comprising:

a first flow path formed in said housing to provide fluid communication from an inlet to a first outlet;

a first valve interposed in said first flow path between said inlet and said first outlet, wherein the first valve is configured so that a fluid pressure in the faucet maintains the first valve in the first position;

a second flow path formed in said housing to provide fluid communication from said first valve to a second outlet;

a second valve interposed in said second flow path between said first valve and said second outlet, wherein the second valve is configured so that a fluid pressure in the faucet maintains the second valve in the third position;

a third flow path formed in said housing to provide fluid communication from said second valve to a third outlet;

wherein said first valve is operable in a first position to provide fluid communication from said inlet through said first flow path to said first outlet and a second position to provide fluid communication from said inlet to said second flow path; and wherein said second valve independent from said first valve is operable in a third position to provide fluid communication from said first valve to said second outlet through said second flow path and a fourth position to provide fluid communication from said first valve through said third flow path to said third outlet.

* * * * *